US012110604B2

(12) United States Patent
Kondoh

(10) Patent No.: US 12,110,604 B2
(45) Date of Patent: Oct. 8, 2024

(54) FILM FORMING APPARATUS FOR FORMING METAL FILM AND FILM FORMING METHOD FOR FORMING METAL FILM

(71) Applicant: TOYOTA JIDOSHA KABUSHIKI KAISHA, Toyota (JP)

(72) Inventor: Haruki Kondoh, Okazaki (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 18/045,503

(22) Filed: Oct. 11, 2022

(65) Prior Publication Data

US 2023/0117855 A1 Apr. 20, 2023

(30) Foreign Application Priority Data

Oct. 14, 2021 (JP) ..... 2021-168478

(51) Int. Cl.

| | |
|---|---|
| ***C25D 21/08*** | (2006.01) |
| ***C25D 5/48*** | (2006.01) |
| ***C25D 17/00*** | (2006.01) |
| ***C25D 17/02*** | (2006.01) |

(52) U.S. Cl.

CPC ..... *C25D 17/002* (2013.01); *C25D 5/48* (2013.01); *C25D 17/02* (2013.01); *C25D 21/08* (2013.01)

(58) Field of Classification Search

CPC ..... C25D 17/002

See application file for complete search history.

(56) References Cited

U.S. PATENT DOCUMENTS 4,404,078 A * 9/1983 Francis ..... C25D 5/02 204/224 R
6,197,182 B1 * 3/2001 Kaufman ..... H01L 21/2885 205/147

(Continued)

FOREIGN PATENT DOCUMENTS

JP 5605517 B2 10/2014
WO WO-2020106590 A1 * 5/2020 ..... C25D 17/001

OTHER PUBLICATIONS

Hwang, Original & Machine Translation, KR 20110115801 A (Year: 2011).*

(Continued)

*Primary Examiner* — Hosung Chung
(74) *Attorney, Agent, or Firm* — Dickinson Wright, PLLC

(57) ABSTRACT

Provided is a film forming apparatus and a film forming method for forming a metal film capable of reducing the occurrence of discoloring or alteration of the metal film caused by drying of an electrolytic solution remaining on the surface of the formed metal film. A space where the metal film exists is sealed between a housing and a mount base in a state where the solid electrolyte membrane is in contact with the metal film. The film forming apparatus includes a water supply unit supplying a wash water to the sealed space such that the wash water flows onto the surface of the metal film being in contact with the solid electrolyte membrane, and a water discharge unit discharging a wash water from the sealed space such that the wash water having flowed onto the surface of the metal film flows out from the surface of the metal film.

6 Claims, 6 Drawing Sheets

(56) References Cited

U.S. PATENT DOCUMENTS

| | | | | |
|---|---|---|---|---|
| 2004/0219775 | A1* | 11/2004 | Shimoyama | H01L 21/4853<br>257/E23.021 |
| 2012/0138471 | A1* | 6/2012 | Mayer | C25D 21/12<br>204/275.1 |
| 2013/0306483 | A1* | 11/2013 | Araki | C25D 21/22<br>205/99 |
| 2015/0014178 | A1 | 1/2015 | Hiraoka et al. | |
| 2015/0329982 | A1* | 11/2015 | Miura | C25D 7/0607<br>204/232 |
| 2017/0342583 | A1* | 11/2017 | Thorkelsson | C25D 17/004 |

OTHER PUBLICATIONS

Kameyama, Original & Machine Translation, JP 2001234390 A (Year: 2001).*

* cited by examiner

FILM FORMING APPARATUS FOR FORMING METAL FILM AND FILM FORMING METHOD FOR FORMING METAL FILM

CROSS REFERENCE TO RELATED APPLICATIONS

The present application claims priority from Japanese patent application JP 2021-168478 filed on Oct. 14, 2021, the entire content of which is hereby incorporated by reference into this application.

BACKGROUND

Technical Field

The present disclosure relates to a film forming apparatus and a film forming method for forming a metal film from metal ions on a surface of a substrate.

Background Art

For example, JP 5605517 B proposes a film forming apparatus including: an anode; a solid electrolyte membrane that is disposed between the anode and a substrate that serves as a cathode: a power supply that applies a voltage across the anode and the substrate; and a mount base on which the substrate is placed. This film forming apparatus can form a metal film on the surface of the substrate from metal ions derived from an electrolytic solution stored in a storing chamber of a housing by applying a current between the anode and the substrate that serves as a cathode in a state where the solid electrolyte membrane that seals the storing chamber is pressed against the substrate.

SUMMARY

In the film forming apparatus of JP 5605517 B, however, the electrolytic solution may slightly remain on the surface of the formed metal film. When the remaining electrolytic solution is dried on the surface of the metal film, the metal film may be discolored or altered.

In view of the forgoing, the present disclosure provides a film forming apparatus and a film forming method for forming a metal film capable of reducing the occurrence of discoloring or alteration of the metal film caused by drying of the electrolytic solution remaining on the surface of the formed metal film.

In view of the foregoing, a film forming apparatus for forming a metal film according to the present disclosure includes: an anode: a solid electrolyte membrane disposed between the anode and a substrate that serves as a cathode: a power supply configured to apply a voltage across the anode and the substrate: a housing including a storing chamber that stores an electrolytic solution together with the anode and having the solid electrolyte membrane attached thereto so as to seal the storing chamber; and a mount base on which the substrate is placed, the mount base being disposed to face the housing, in which the voltage is applied in a state where the solid electrolyte membrane is pressed against a surface of the substrate with a fluid pressure of the electrolytic solution in the storing chamber to form a metal film from metal ions contained in the electrolytic solution on a surface of the substrate, a space where the metal film exists is sealed between the housing and the mount base in a state where the solid electrolyte membrane is in contact with the metal film, and the film forming apparatus further includes: a water supply unit configured to supply a wash water to the space being sealed such that the wash water flows onto a surface of the metal film that is in contact with the solid electrolyte membrane; and a water discharge unit configured to discharge a wash water from the space being sealed such that the wash water having flowed onto the surface of the metal film flows out from the surface of the metal film.

According to the present disclosure, it is possible to deposit metal on the surface of the substrate by applying a voltage across the anode and the substrate in a state where the solid electrolyte membrane is pressed against the surface of the substrate with a fluid pressure of the electrolytic solution in the storing chamber and allowing metal ions contained in the electrolytic solution stored in the storing chamber to pass through the solid electrolyte membrane. Accordingly, a metal film can be formed on the surface of the substrate.

Here, according to the present disclosure, a space where the metal film exists is sealed between the housing and the mount base in a state where the solid electrolyte membrane is in contact with the metal film, and the metal film can be washed in the sealed space. Specifically, with the water supply unit, it is possible to pour a wash water onto the surface of the metal film that is in contact with the solid electrolyte membrane in the sealed space. Meanwhile, with the water discharge unit, it is possible to allow the wash water having flowed onto the surface of the metal film to flow out from between the solid electrolyte membrane and the metal film.

Accordingly, even if the electrolytic solution remains on the formed metal film, it is possible to wash out the remaining electrolytic solution from the surface of the metal film while preventing the electrolytic solution from drying in contact with the atmosphere or the like and to discharge the electrolytic solution from between the solid electrolyte membrane and the metal film together with the wash water. Consequently, it is possible to reduce the occurrence of discoloring or alteration of the metal film caused by drying of the electrolytic solution remaining on the surface of the metal film.

Here, washing of the metal film by the water supply unit and the water discharge unit may be performed manually, and the washing method is not particularly limited as long as the metal film can be washed. However, in some embodiments, the film forming apparatus may further include a liquid discharge mechanism configured to discharge an electrolytic solution from the storing chamber; and a control device configured to control at least discharge of the electrolytic solution by the liquid discharge mechanism and supply of the wash water by the water supply unit, in which the control device causes the liquid discharge mechanism to discharge the electrolytic solution in the storing chamber and causes the water supply unit to supply the wash water.

Once the control device causes the liquid discharge mechanism to discharge the electrolytic solution in the storing chamber after completion of formation of the metal film, the fluid pressure acting on the solid electrolyte membrane decreases, and thus the pressing force of the solid electrolyte membrane pressing the substrate also decreases. Accordingly, the solid electrolyte membrane tends to deform so as to be separated from the substrate. Then, in this embodiment, the control device causes the water supply unit to supply the wash water along with discharge of the electrolytic solution, whereby the solid electrolyte membrane deforms so as to be separated from the surface of the substrate, and the wash water may be easily poured between the solid electrolyte membrane and the metal film.

In particular, when the solid electrolyte membrane is pressed from above the substrate to form a film, the fluid pressure easily acts on the solid electrolyte membrane toward the substrate due to the weight of the electrolytic solution stored in the storing chamber. According to this embodiment, discharging the electrolytic solution reduces the fluid pressure acting on the solid electrolyte membrane due to its own weight, and thus the wash water may be easily poured between the solid electrolyte membrane and the metal film.

Here, as long as the metal film can be washed with a wash water, the structure of the water supply unit and the water discharge unit is not particularly limited. However, in some embodiments, the mount base includes a housing recess that houses the substrate, the water supply unit includes a water supply groove on a surface of the mount base, the water discharge unit includes a water discharge groove on a surface of the mount base, and the water supply groove and the water discharge groove are formed in opposite positions with the housing recess interposed therebetween.

According to this embodiment, since the water supply groove and the water discharge groove are formed in the opposite positions with the housing recess interposed therebetween, when the wash water is supplied to the sealed space via the water supply groove, it is possible to easily pour the wash water over the entire metal film from one side of the metal film and uniformly discharge the poured wash water from the sealed space via the water discharge groove on the other side of the metal film.

A film forming method for forming a metal film according to the present disclosure is a film forming method for forming a metal film from metal ions contained in an electrolytic solution on a surface of a substrate by applying a voltage across an anode and the substrate that serves as a cathode in a state where a solid electrolyte membrane that seals a storing chamber of a housing is pressed against the substrate with a fluid pressure of the electrolytic solution stored in the storing chamber, the film forming method including: placing the substrate on a mount base disposed to face the housing: bringing the solid electrolyte membrane into contact with the substrate placed on the mount base and pressing the solid electrolyte membrane against the substrate with the fluid pressure: in a state where the solid electrolyte membrane is pressed, applying a voltage across the anode and the substrate to form the metal film on a surface of the substrate; and washing the metal film in a space where the metal film exists, the space being sealed between the housing and the mount base in a state where the solid electrolyte membrane is in contact with the metal film, in which in the washing the metal film, a wash water is supplied to the space being sealed such that the wash water flows onto a surface of the metal film that is in contact with the solid electrolyte membrane and the wash water having flowed onto the surface of the metal film is discharged from the space being sealed.

According to the present disclosure, in the forming the metal film, a voltage is applied across the anode and the substrate in a state where the solid electrolyte membrane is pressed against the surface of the substrate with a fluid pressure of the electrolytic solution in the storing chamber. Accordingly, it is possible to deposit metal on the surface of the substrate by allowing metal ions contained in the electrolytic solution stored in the storing chamber to pass through the solid electrolyte membrane. Consequently, a metal film can be formed on the surface of the substrate.

In addition, according to the present disclosure, a space where the metal film exists is sealed between the housing and the mount base in a state where the solid electrolyte membrane is in contact with the metal film. Therefore, after the forming the metal film, in the washing the metal film, by supplying a wash water to the sealed space, it is possible to pour the wash water between the solid electrolyte membrane and the metal film that is in contact with the solid electrolyte membrane and discharge the wash water poured onto the surface of the metal film from the sealed space.

As described above, even if the electrolytic solution remains on the formed metal film, it is possible to wash out the remaining electrolytic solution from the surface of the metal film with the wash water while preventing the electrolytic solution from drying in contact with the atmosphere or the like and to discharge the electrolytic solution from between the solid electrolyte membrane and the metal film together with the wash water. Consequently, it is possible to reduce the occurrence of discoloring or alteration of the metal film caused by drying of the electrolytic solution remaining on the surface of the metal film.

In some embodiments, in the washing the metal film, a wash water is supplied to the space being sealed while the electrolytic solution is discharged from the storing chamber.

According to this embodiment, since a wash water is supplied to the sealed space while the electrolytic solution is discharged from the storing chamber, the solid electrolyte membrane tends to deform so as to be separated from the surface of the substrate with a fluid pressure of the wash water, and the wash water can be easily poured between the solid electrolyte membrane and the metal film. In particular, when the solid electrolyte membrane is pressed from above the substrate to form a film, discharging the electrolytic solution reduces such a fluid pressure, and thus the wash water may be easily poured between the solid electrolyte membrane and the metal film.

In addition, in some embodiments, the mount base includes a housing recess that houses the substrate, a water supply groove and a water discharge groove are formed in opposite positions with the housing recess interposed therebetween, and in the washing the metal film, a wash water is supplied to the space being sealed via the water supply groove and a wash water is discharged from the space being sealed via the water discharge groove.

According to this embodiment, since the water supply groove and the water discharge groove are formed in the opposite positions with the housing recess interposed therebetween, when the wash water is supplied to the sealed space via the water supply groove, the wash water can be passed over the entire metal film from one side of the metal film toward the other side of the metal film. This allows the washing to be performed more uniformly.

According to the film forming apparatus and the film forming method for forming a metal film of the present disclosure, it is possible to reduce the occurrence of discoloring or alteration of the metal film caused by drying of the electrolytic solution remaining on the surface of the formed metal film.

DETAILED DESCRIPTION

Hereinafter, one embodiment according to the present disclosure will be described with reference to FIG. 1 to FIG. 6.

1. Regarding Structure of Film Forming Apparatus 1

A film forming apparatus 1 for forming a metal film according to the present embodiment will be described with reference to FIG. 1 and FIG. 2. The film forming apparatus 1 of the present embodiment is a film forming apparatus (plating apparatus) for forming a metal film by solid electrolyte deposition using a solid electrolyte membrane. The film forming apparatus 1 is used when forming a metal film F on the surface of a substrate W that serves as a cathode. The film forming apparatus 1 may also be used when continuously forming a metal film F on the surfaces of a plurality of substrates W. The substrate W that serves as a cathode may be a substrate made of a metal material such as copper, nickel, silver, gold, or the like, or may be a substrate including a metal base layer of copper, nickel, silver, gold, or the like formed on a surface of resin, ceramic, or the like. When forming a metal film, this metal base layer is conductive to a negative electrode of a power supply 13 (described later), and serves as a cathode.

Figure 1:
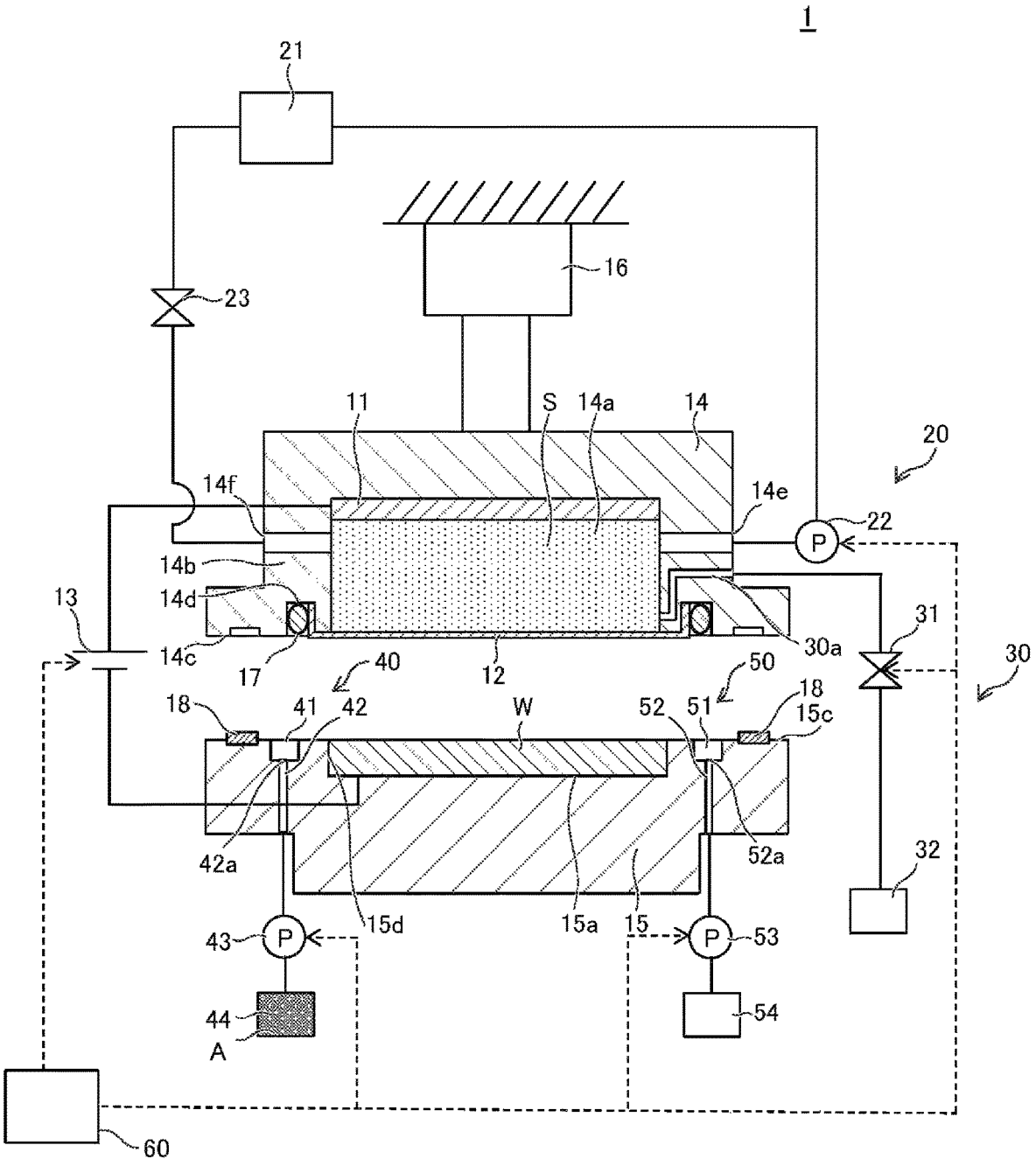
FIG. 1 is a schematic cross-sectional view of a film forming apparatus for forming a metal film according to one embodiment of the present disclosure, illustrating a state where a substrate is placed thereon.

As shown in FIG. 1, the film forming apparatus 1 includes an anode 11, a solid electrolyte membrane 12 that is disposed between the anode 11 and the substrate W, and a power supply (power supply unit) 13 that applies a voltage across the anode 11 and the substrate W. The film forming apparatus 1 further includes a housing 14 including a storing chamber 14*a* that stores an electrolytic solution S, and a mount base 15 on which the substrate W is placed. The power supply 13 is DC power supply or AC power supply.

In the present embodiment, the anode 11 is electrically coupled to a positive electrode of the power supply 13 and the mount base 15 is electrically coupled to a negative electrode of the power supply 13. Since the mount base 15 is made of a conductive material, the substrate W is conductive to the negative electrode of the power supply 13. Accordingly, the film forming apparatus 1 can apply a current between the anode 11 and the substrate W by applying a voltage across the anode 11 and the substrate W with the power supply 13 in a state where the solid electrolyte membrane 12 is in contact with the surface of the substrate W.

In the present embodiment, the anode 11 is a plate-like metal anode, for example, and may be either a soluble anode made of the same material (e.g., Cu) as the metal film F, or an anode made of a material (e.g., Ti) that is insoluble in the electrolytic solution S.

The solid electrolyte membrane 12 is not particularly limited as long as it can be impregnated with metal ions (i.e., can contain metal ions therein) when brought into contact with the electrolytic solution S and metal derived from metal ions can be deposited on the surface of the cathode (substrate W) when the anode 11 and the cathode are energized.

The thickness of the solid electrolyte membrane 12 is set such that the solid electrolyte membrane 12 has flexibility with a fluid pressure of the electrolytic solution S, which will be described later. The thickness of the solid electrolyte membrane 12 may be in the range of 1 μm to 200 μm, for example. Examples of the material of the solid electrolyte membrane 12 may include a fluorine-based resin, such as Nafion (registered trademark) available from DuPont, a hydrocarbon-based resin, a polyamic resin, or a resin having cation exchange functionality, such as Selemion (CMV, CMD, CMF series) available from AGC Inc.

The electrolytic solution S is a solution containing metal in a state of ions of the metal film F. The metal may be Cu, Ni, Zn, Ag, Sn, Au, or the like, for example. The electrolytic solution S may be a solution containing such metal dissolved (ionized) in an acid, such as nitric acid, phosphoric acid, succinic acid, sulfuric acid, pyrophosphoric acid, or the like.

In the present embodiment, the housing 14 is made of a material that is insoluble in the electrolytic solution S. The housing 14 includes the storing chamber 14*a* that stores the electrolytic solution S together with the anode 11. The solid electrolyte membrane 12 is attached to the housing 14 so as to seal the storing chamber 14*a* that is open downward. Specifically, the anode 11 is disposed in the storing chamber 14*a* such that the anode 11 and the solid electrolyte membrane 12 are spaced apart from each other, and the electrolytic solution S is stored between the anode 11 and the solid electrolyte membrane 12 so as to be in contact with them.

In the present embodiment, the housing 14 includes, on an a end face 14*c* of a side wall 14*b*, an insertion groove 14*d* into which a sealing member 17 is inserted in a state where the edge of the solid electrolyte membrane 12 is bent. The insertion groove 14*d* is formed around the opening of the storing chamber 14*a*. The sealing member 17 is inserted into the insertion groove 14*d* in a state where the edge of the solid electrolyte membrane 12 is bent, and the elastically deformed sealing member 17 is pressed against the edge of the solid electrolyte membrane 12 such that the solid electrolyte membrane 12 can seal the storing chamber 14*a* that is open downward.

The housing 14 includes a supply port 14*e* through which the electrolytic solution S is supplied and a discharge port 14*f* through which the electrolytic solution S is discharged. The supply port 14*e* and the discharge port 14*f* are coupled to a tank 21 via a pipe. A pressure pump 22 for pressure-feeding the electrolytic solution S in the tank 21 is provided between the tank 21 and the supply port 14*e*. Accordingly, the electrolytic solution S fed by the pressure pump 22 from the tank 21 is introduced into the storing chamber 14*a* through the supply port 14*e*, and the introduced electrolytic solution S is discharged through the discharge port 14*f* such that the discharged electrolytic solution S can return to the tank 21.

In addition, in the present embodiment, a pressure regulating valve 23 is provided downstream of the discharge port 14*f*. The pressure regulating valve 23 and the pressure pump 22 can increase the pressure of the electrolytic solution S in the storing chamber 14*a* to a predetermined pressure. In this manner, the solid electrolyte membrane 12 can be pressed against the substrate W that is in contact with the solid electrolyte membrane 12 with a fluid pressure of the electrolytic solution S during film formation (see FIG. 5). Accordingly, it is possible to form a metal film F on the substrate W while uniformly pressurizing the substrate W with the solid electrolyte membrane 12. It should be noted that in this specification, the pressure regulating valve 23 and the pressure pump 22 correspond to a pressing mechanism 20.

The mount base 15 includes a housing recess 15*a* that is formed in accordance with the shape of the substrate W. In the present embodiment, in one example, in a state where the substrate W is housed in the housing recess 15*a*, there may be no clearance between the side wall surface of the housing recess 15*a* and the side surface of the substrate W, and specifically, a surface 15*c* of the mount base 15 and the surface of the substrate W may be formed on the same plane. Accordingly, a wash water A may be easily poured onto the surface of a metal film F by a water supply unit 40, which will be described later, and the poured wash water A may be easily discharged by a water discharge unit 50, which will be described later.

It should be noted that in the present embodiment, the film forming apparatus 1 further includes an elevating device 16 coupled to the upper part of the housing 14. The elevating device 16 is configured to move the housing 14 upward and downward between a position where the solid electrolyte membrane 12 is spaced apart from the substrate W and a position where the solid electrolyte membrane 12 comes into contact with the substrate W. Details of the elevating device 16 are not limited as long as the elevating device 16 can move the housing 14 upward and downward, and the elevating device 16 may be configured by a hydraulic or pneumatic cylinder, a motor-driven actuator, a linear guide and a motor, for example.

In the present embodiment, the film forming apparatus 1 further includes a liquid discharge mechanism 30 configured to discharge the electrolytic solution S stored in the storing chamber 14*a*. Specifically, the liquid discharge mechanism 30 includes a communication passage 30*a* communicated with the storing chamber 14*a*, an on-off valve 31, such as a solenoid valve, attached to the communication passage 30*a*, and a storage tank 32 that stores the electrolytic solution S discharged from the storing chamber 14*a*.

The storage tank 32 is coupled to the communication passage 30*a* formed in the side wall 14*b* of the housing 14 via a pipe, and the on-off valve 31 is disposed between the communication passage 30*a* and the storage tank 32. When the on-off valve 31 is open, the electrolytic solution S is discharged from the storing chamber 14*a*, and when the on-off valve 31 is closed, sealability of the storing chamber 14*a* is ensured. In addition to this, after the on-off valve 31 or the pressure regulating valve 23 is opened, air may be pressure-fed to the storing chamber 14*a* through the supply port 14*e* of the housing 14 via an air pump (not shown), and the electrolytic solution S in the storing chamber 14*a* may be discharged through the discharge port 14*f*.

By the way, during film formation, the electrolytic solution S passes through the solid electrolyte membrane 12, and the electrolytic solution S may slightly remain on the surface of the metal film F. When the remaining electrolytic solution S, which is an acidic solution, is dried on the surface of the metal film F, the metal film F may be discolored or altered. In view of this, the present embodiment employs the following apparatus configuration.

Figure 5:
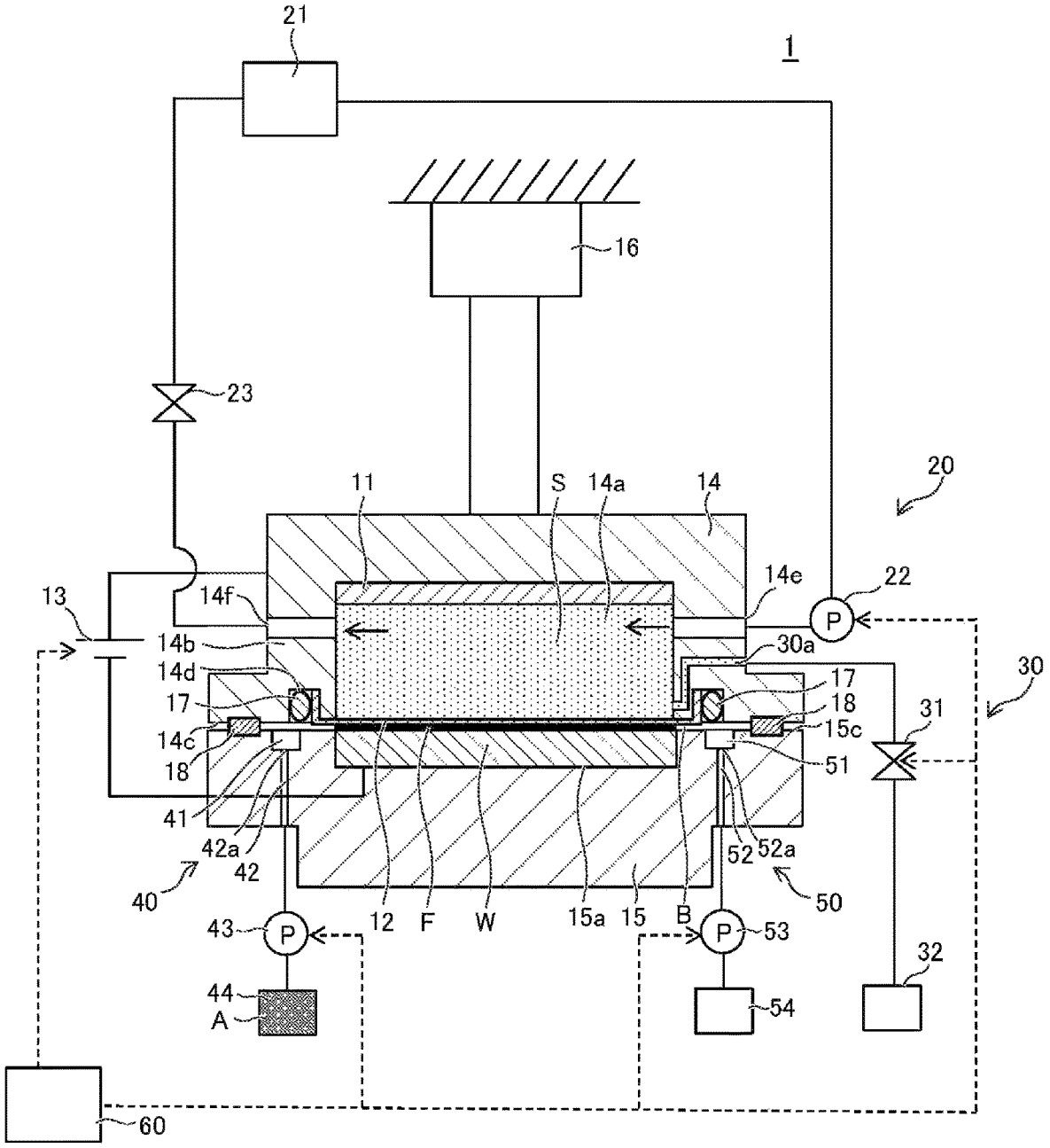
FIG. 5 is a schematic conceptual view illustrating a film forming step of forming a metal film shown in FIG. 4.

In the present embodiment, the film forming apparatus 1 further includes a sealing member 18, a water supply unit (a water supply structure) 40, and a water discharge unit (a water discharge structure) 50. As shown in FIG. 5, in a state where the solid electrolyte membrane 12 is in contact with the metal film F, a space where the metal film F exists is sealed by the sealing member 18 between the housing 14 and the mount base 15. The space where the metal film F exists means a space sealed so as to enclose the metal film F.

The structure of the sealing member 18 is not particularly limited as long as it can form such a sealed space (sealed space B). The sealing member 18 may be a frame-like member made of rubber or resin, or the housing 14 and the mount base 15 may form a mechanical seal. Although the sealing member 18 is disposed on the mount base 15 in the present embodiment, the sealing member 18 may be disposed on the housing 14, for example.

Figure 2:
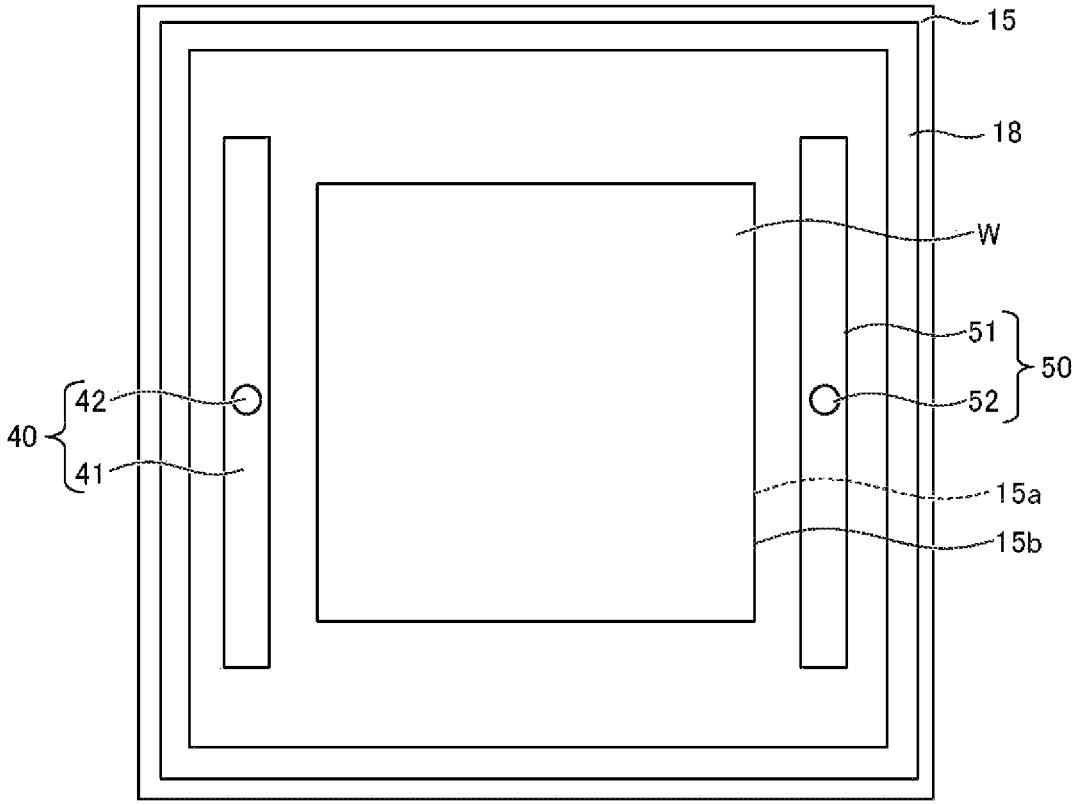
FIG. 2 illustrates a mount base of the film forming apparatus shown in FIG. 1 as seen from a housing side.

As shown in FIG. 2, the sealing member 18 is disposed on the surface 15*c* of the mount base 15 so as to surround a water supply groove 41, the housing recess 15*a*, and a water discharge groove 51, which will be described later. In the present embodiment, when the housing 14 is moved downward by the elevating device 16, the sealing member 18 is sandwiched between the housing 14 and the mount base 15 and compressively deformed. Accordingly, a sealed space B surrounded by the sealing member 18 is formed between the housing 14 and the mount base 15 (see FIG. 5).

The water supply unit 40 is configured to supply a wash water A to the sealed space B such that the wash water A flows onto the surface of the metal film F that is in contact with the solid electrolyte membrane 12. The water supply unit 40 includes the water supply groove 41 formed on the surface 15*c* of the mount base 15 and the water supply passage 42 formed in the mount base 15. The water supply groove 41 is communicated with the water supply passage 42 via a coupling portion 42*a*. Although the water supply groove 41 is provided in the present embodiment, instead of the water supply groove 41, one or more end portions of the water supply passage 42 may serve as a water supply port provided on the surface 15*c* of the mount base 15, for example.

The structure of the water supply unit 40 is not limited as long as it can pour the wash water A onto the surface of the metal film F that is in contact with the solid electrolyte membrane 12. That is, the structure of the water supply unit 40 is not particularly limited as long as it can ensure a pressure with which the water supply unit 40 can pour the wash water A between the solid electrolyte membrane 12 and the metal film F that are in contact with each other.

More specifically, the water supply unit 40 may further include a water supply tank 44 that stores the wash water A and a pressure pump 43 that pressure-feeds the wash water A from the water supply tank 44 to the water supply passage 42. Accordingly, the water supply unit 40 may pressure-feed the wash water A in the water supply tank 44 to the inside of the sealed space B with the pressure pump 43 and easily pour the wash water A between the solid electrolyte membrane 12 and the metal film F. It should be noted that as long as the wash water A can wash the surface of the metal film F, the wash water A is not particularly limited, but may be pure water with few impurities.

The water discharge unit 50 is configured to discharge the wash water A from the sealed space B such that the wash water A having flowed onto the surface of the metal film F flows out from the surface of the metal film F. The water discharge unit 50 includes a water discharge groove 51 formed on the surface 15*c* of the mount base 15 and a water discharge passage 52 formed in the mount base 15. The water discharge groove 51 is communicated with the water discharge passage 52 via a coupling portion 52*a*. Although the water discharge groove 51 is provided in the present embodiment, instead of the water discharge groove 51, one or more end portions of the water discharge passage 52 may serve as a water discharge port provided on the surface 15*c* of the mount base 15, for example.

More specifically, the water discharge unit 50 further includes a suction pump 53 that sucks the wash water A in the sealed space B via the water discharge passage 52 and a water discharge tank 54 that stores the sucked wash water A. Accordingly, with the suction pump 53, the water discharge unit 50 may suck out the wash water A poured between the solid electrolyte membrane 12 and the metal film F and may easily discharge the wash water A from the sealed space B.

Here, as shown in FIG. 2, in the present embodiment, the water supply groove 41 and the water discharge groove 51 are formed with a distance from an edge 15*b* of the housing recess 15*a*. In addition, the water supply groove 41 and the water discharge groove 51 are formed in the opposite positions with the housing recess 15*a* interposed therebetween. Accordingly, when the wash water A is supplied to the sealed space B via the water supply groove 41, the wash water A can be passed over the entire metal film F from one side of the metal film F toward the other side of the metal film F, thus allowing the washing to be performed more uniformly.

Figure 3:
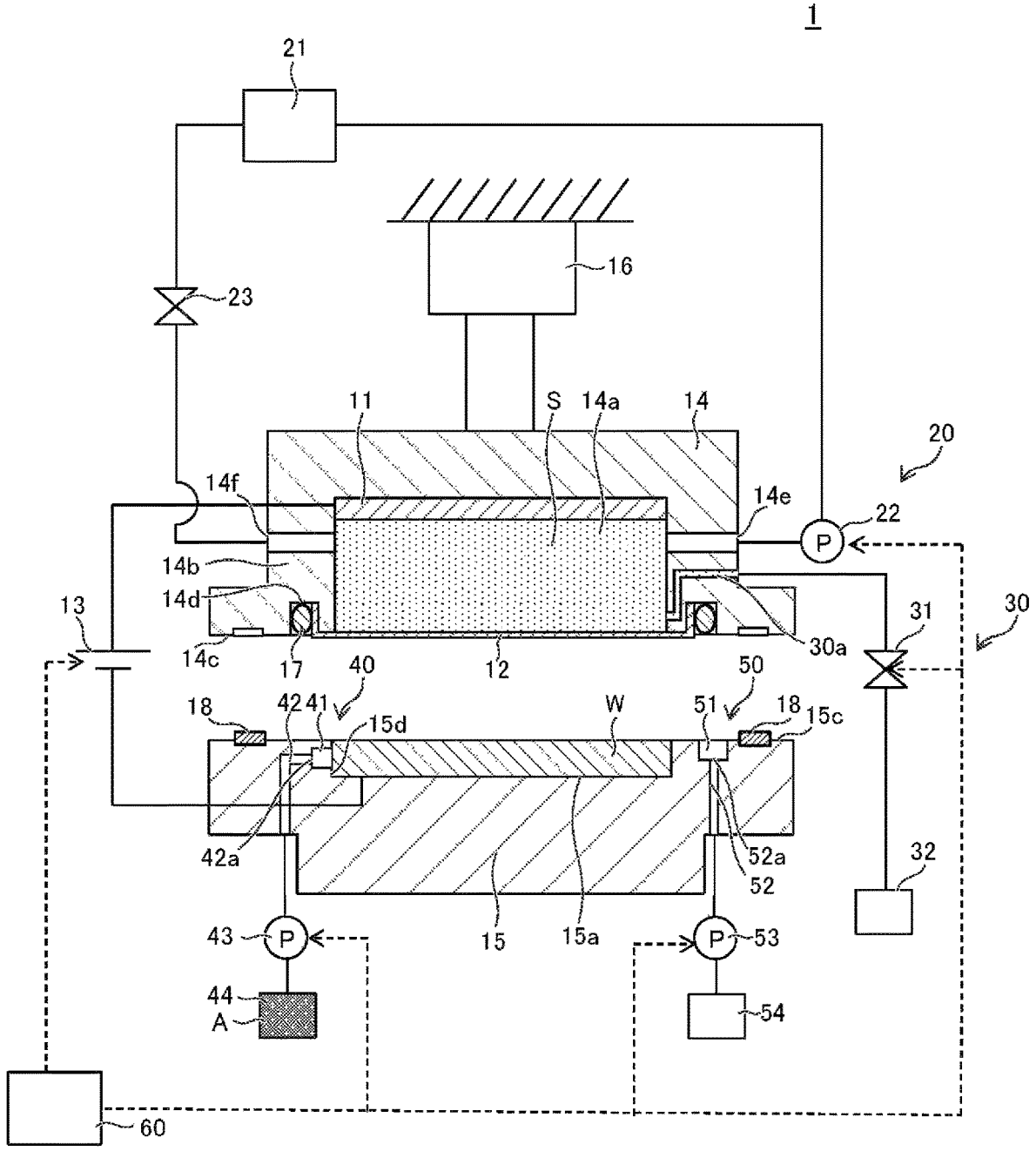
FIG. 3 is a view illustrating a modification of a water supply unit of the film forming apparatus shown in FIG. 1.

Here, as shown in FIG. 1 and FIG. 2, the present embodiment has described the example of the water supply groove 41 formed on the surface 15*c* of the mount base 15, but is not limited thereto, and as shown in FIG. 3, the water supply groove 41 may be formed on a side surface 15*d* of the housing recess 15*a*. Since this allows the wash water A to be directly sprayed on the side surface of the substrate W, it is possible to efficiently pour the wash water A onto the surface of the metal film F formed on the substrate W.

In the present embodiment, the film forming apparatus 1 includes the sealed space B that is formed between the housing 14 and the mount base 15 in a state the solid electrolyte membrane 12 is in contact with the metal film F. This can prevent leakage of the wash water A supplied between the housing 14 and the mount base 15 during washing. When the wash water A is supplied between the housing 14 and the mount base 15, the fluid pressure of the wash water A increases, and the wash water A easily enters between the solid electrolyte membrane 12 and the substrate W.

In addition, in the present embodiment, the film forming apparatus 1 further includes a control device 60 configured to control starting and stopping of the pressure pump 22 of the pressing mechanism 20, supply of the wash water A by the water supply unit 40, discharge of the wash water A by the water discharge unit 50, discharge of the electrolytic solution S by the liquid discharge mechanism 30, and voltage application and stopping of the voltage application by the power supply 13. Specifically, the control device 60 transmits control signals to the pressure pump 22 of the pressing mechanism 20, the pressure pump 43 that pressure-feeds the wash water A to the water supply unit 40, the suction pump 53 that sucks the wash water A, the on-off valve 31 of the liquid discharge mechanism 30, and the power supply 13, and controls them.

The control device 60 basically includes, as hardware, an operation unit, such as a CPU or the like, a storage unit, such as RAM, ROM, or the like. The operation unit calculates control signals to the pressure pump 22, the pressure pump 43, the suction pump 53, the on-off valve 31, and the power supply 13, and transmits these control signals. The storage unit stores a discharge time set in advance, for example.

As described above, since the electrolytic solution S may slightly remain on the surface of the metal film F during film formation, in the present embodiment, the control device 60 causes the liquid discharge mechanism 30 to discharge the electrolytic solution S in the storing chamber 14*a* and causes the water supply unit 40 to supply the wash water A. It should be noted that control by the control device 60 will be described in detail later in the description of the steps of the film forming method for forming a metal film F shown in FIG. 4.

According to the film forming apparatus 1 of the present embodiment, the space where the metal film F exists is sealed between the housing 14 and the mount base 15 in a state where the solid electrolyte membrane 12 is in contact with the metal film F, and the metal film F can be washed within this sealed space (sealed space B). Specifically, with the water supply unit 40, it is possible to pour the wash water A onto the surface of the metal film F that is in contact with the solid electrolyte membrane 12 in the sealed space B. Meanwhile, with the water discharge unit 50, it is possible to allow the wash water A having flowed onto the surface of the metal film F to flow out from between the solid electrolyte membrane 12 and the metal film F. In particular, the control device 60 causes the liquid discharge mechanism 30 to discharge the electrolytic solution S in the storing chamber 14*a* and causes the water supply unit 40 to supply the wash water A, and thus it is possible to more easily pour the wash water A between the solid electrolyte membrane 12 and the metal film F.

Through the above-described flow of the wash water A from the water supply unit 40 to the water discharge unit 50, even if the electrolytic solution S remains on the surface of the formed metal film F, the remaining electrolytic solution S can be washed out from the surface of the metal film F while preventing the electrolytic solution S from drying in contact with the atmosphere or the like. The washed out electrolytic solution S can be discharged from between the solid electrolyte membrane 12 and the metal film F together with the wash water A. Consequently, it is possible to reduce the occurrence of discoloring or alteration of the metal film F caused by drying of the electrolytic solution S remaining on the surface of the metal film F.

2. Regarding Film Forming Method for Forming Metal Film F

Figure 4:
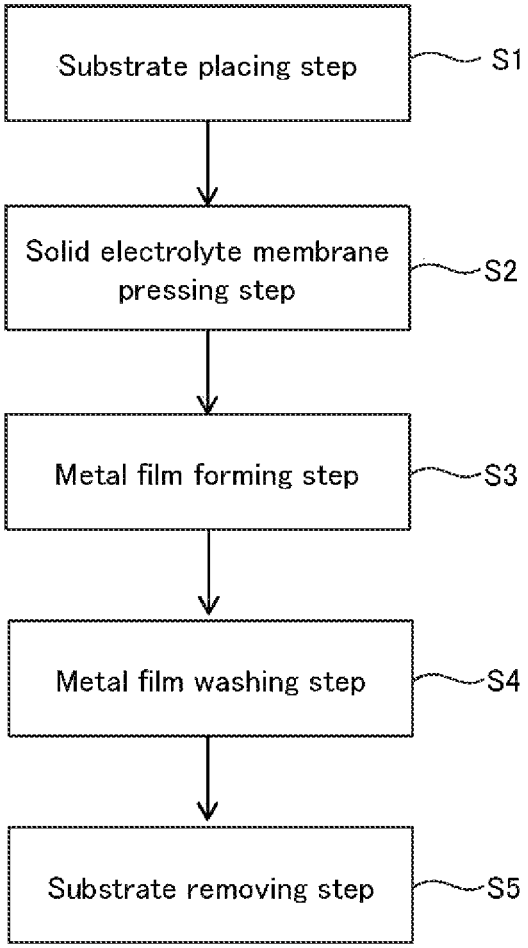
FIG. 4 is a flowchart of the steps of a film forming method for forming a metal film using the film forming apparatus shown in FIG. 1.
Figure 6:
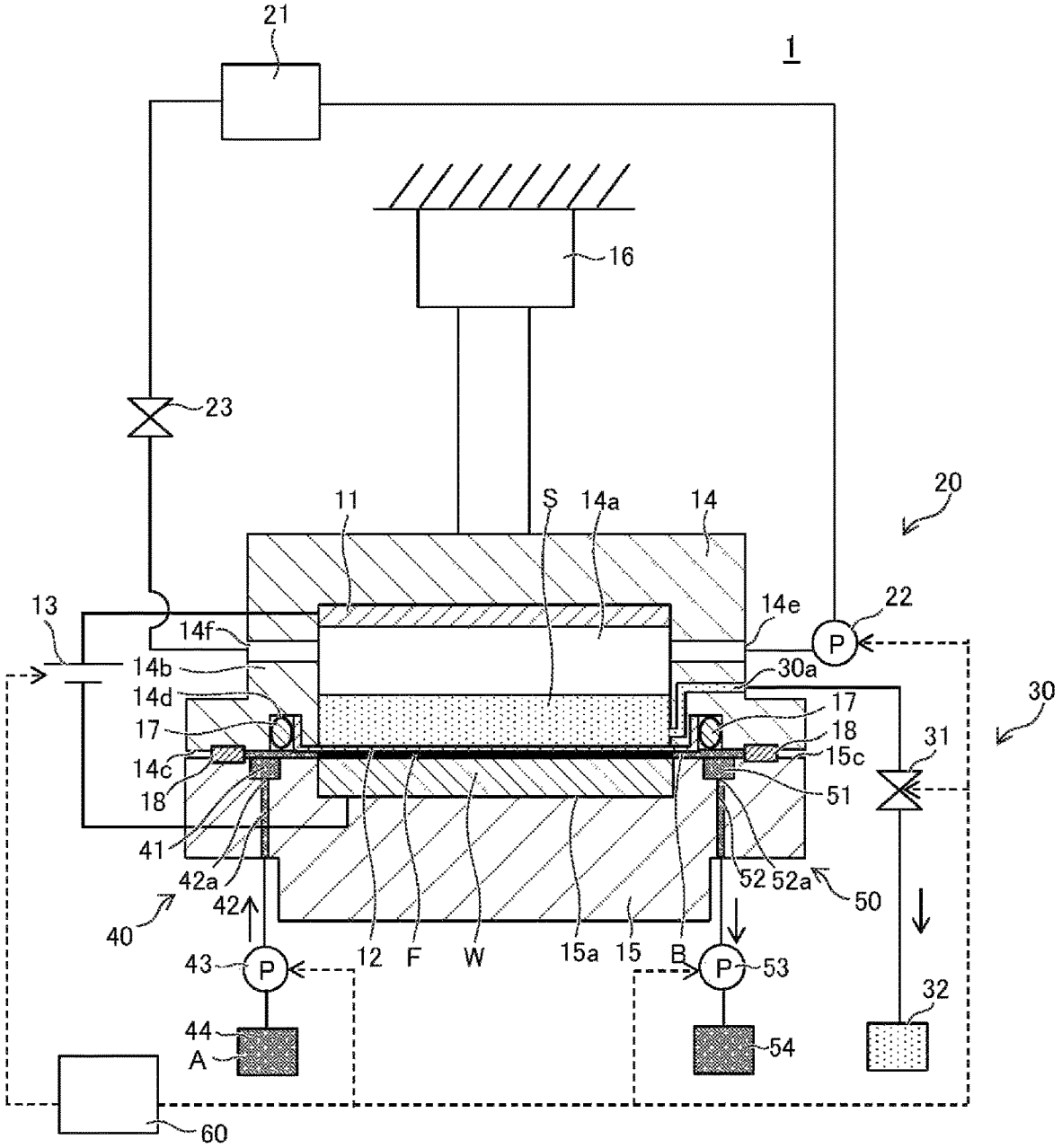
FIG. 6 is a schematic conceptual view illustrating a metal film washing step shown in FIG. 4.

A film forming method for forming a metal film F according to the present embodiment will be described with reference to FIG. 4 to FIG. 6. It should be noted that the film forming method will be described with reference to the flow of the steps shown in FIG. 4.

2-1. Regarding Substrate W Placing Step S1

The film forming method for forming a metal film F according to the present embodiment first performs a substrate W placing step S1. In this step, the substrate W is placed on the mount base 15 (see FIG. 1). Specifically, in a state where the housing 14 is disposed above the mount base 15, the substrate W is housed in the housing recess 15*a* of the mount base 15. Accordingly, the substrate W is placed in a position opposite to the solid electrolyte membrane 12.

In the present embodiment, the water supply groove 41 and the water discharge groove 51 are formed in the opposite positions with the housing recess 15*a* interposed therebetween, and the frame-like sealing member 18 is disposed on the edge of the mount base 15 so as to surround the water supply groove 41 and the water discharge groove 51. Therefore, housing the substrate W in the housing recess 15*a* makes the water supply groove 41, the substrate W, and the water discharge groove 51 fit within the frame of the sealing member 18 (see FIG. 2).

2-2. Regarding Solid Electrolyte Membrane 12 Pressing Step S2

Next, the film forming method performs a solid electrolyte membrane 12 pressing step S2. In this step, as shown in FIG. 5, the solid electrolyte membrane 12 attached to the housing 14 is brought into contact with the substrate W placed on the mount base 15 and pressed against the substrate W with a fluid pressure.

Specifically, the elevating device 16 moves the housing 14 including the storing chamber 14*a* that stores the electrolytic solution S toward the substrate W and brings the solid electrolyte membrane 12, which is attached to the housing 14 so as to face the substrate W, into contact with the surface of the substrate W. At this time, the sealing member 18 is sandwiched between the housing 14 and the mount base 15, and thus the sealed space B surrounded by the sealing member 18 is formed between the housing 14 and the mount base 15.

The control device 60 controls the pressure pump 22 to supply the electrolytic solution S to the storing chamber 14*a* from the tank 21 and causes the pressing mechanism 20 (i.e., the pressure pump 22 and the pressure regulating valve 23) to press the solid electrolyte membrane 12 against the substrate W under the pressure conditions for forming a metal film F. It should be noted that in the pressing, the on-off valve 31 is in the closed position to ensure sealability of the storing chamber 14*a*. Consequently, the electrolytic solution S is pressurized by the pressure pump 22 such that the solid electrolyte membrane 12 is allowed to follow the surface of the substrate W, and the pressure of the electrolytic solution S within the housing 14 becomes a constant pressure set by the pressure regulating valve 23. Accordingly, the solid electrolyte membrane 12 can uniformly press the surface of the substrate W with the regulated fluid pressure of the electrolytic solution S within the housing 14.

2-3. Regarding Metal Film Forming Step S3

Next, the film forming method performs a metal film forming step S3. As shown in FIG. 5, in this step, while the solid electrolyte membrane 12 is pressed, the control device 60 controls the power supply 13 to apply a voltage across the anode 11 and the substrate W such that a metal film F is formed on the surface of the substrate W. With such voltage application, metal derived from metal ions contained in the solid electrolyte membrane 12 is deposited, and thus a metal film F derived from metal ions can be formed on the surface of the substrate W. After the metal film F is formed into a desired thickness (specifically, after a constant current is applied between the anode 11 and the substrate W for a predetermined time), the control device 60 controls the power supply 13 to stop application of a voltage across the anode 11 and the substrate W. Then, formation of the metal film F ends. In the present embodiment, the surface of the metal film F is washed in a state where the solid electrolyte membrane 12 is in contact with the formed metal film F, which will be described later.

2-4. Regarding Metal Film Washing Step S4

Next, the film forming method performs a metal film washing step S4. As shown in FIG. 6, in this step, the water supply unit 40 supplies the wash water A to the sealed space B such that the wash water A flows onto the surface of the metal film F that is in contact with the solid electrolyte membrane 12. Meanwhile, the water discharge unit 50 discharges the wash water A having flowed onto the surface of the metal film F from the sealed space B. In the present embodiment, after the wash water A is supplied to the sealed space B, the control device 60 starts the suction pump 53 and controls the water discharge unit 50 to discharge the wash water A used in washing.

Here, the sealability of the sealed space B surrounded by the sealing member 18 is ensured by the sealing member 18 between the housing 14 and the mount base 15. Thus, once the water supply unit 40 located inside of the sealing member 18 supplies the wash water A between the housing 14 and the mount base 15, the fluid pressure of the wash water A increases.

Consequently, even in a state where the solid electrolyte membrane 12 is in contact with the metal film F, it is possible to easily pour the wash water A between the solid electrolyte membrane 12 and the metal film F. Such poured wash water A flows out from between the solid electrolyte membrane 12 and the metal film F and will be discharged from the sealed space B by the water discharge unit 50.

Here, the wash water A may be supplied to the sealed space B while the electrolytic solution S is discharged from the storing chamber 14*a*. Specifically, the control device 60 causes the liquid discharge mechanism 30 to discharge the electrolytic solution S in the storing chamber 14*a* and causes the water supply unit 40 to supply the wash water A. In the present embodiment, the control device 60 transmits a control signal to the pressure pump 22 so as to stop the pressure pump 22 of the pressing mechanism 20 to stop supply of the electrolytic solution S from the tank 21 to the storing chamber 14*a*. In addition, the control device 60 transmits a control signal to the on-off valve 31 so as to open the on-off valve 31 that is in the closed position to discharge the electrolytic solution S in the storing chamber 14*a*. Furthermore, the control device 60 transmits a control signal to the pressure pump 43 so as to start the pressure pump 43 to supply the wash water A.

As described above, once the control device 60 causes the liquid discharge mechanism 30 to discharge the electrolytic solution S in the storing chamber 14*a* after completion of formation of the metal film F, the fluid pressure acting on the solid electrolyte membrane 12 regulated during film formation decreases, and thus the pressing force of the solid electrolyte membrane 12 pressing the substrate W also decreases. Accordingly, the solid electrolyte membrane 12 tends to deform so as to be separated from the substrate W. Then, in the present embodiment, the control device 60 causes the water supply unit 40 to supply the wash water A along with discharge of the electrolytic solution S, whereby the solid electrolyte membrane 12 deforms so as to be separated from the surface of the substrate W, and the wash water A may be easily poured between the solid electrolyte membrane 12 and the metal film F. In this manner, it is possible to increase the washing efficiency of the metal film F.

Here, in the present embodiment, the solid electrolyte membrane 12 seals the storing chamber 14*a* on the lower side of the storing chamber 14*a*. Therefore, when the electrolytic solution S stored in the storing chamber 14*a* is discharged to the storage tank 32, the pressure of the electrolytic solution S acting on the solid electrolyte membrane 12 due to its own weight also decreases. Accordingly, it is possible to easily pour the wash water A between the solid electrolyte membrane 12 and the metal film F.

It should be noted that supply of the wash water A by the water supply unit 40 may be started after discharge of the electrolytic solution S in the storing chamber 14*a* is started and before this discharge is completed. This can complete, within a shorter time, the replacement of the electrolytic solution S in the storing chamber 14*a* (specifically, discharge of the electrolytic solution S) and the washing of the metal film F with the wash water A.

The control device 60 may stop water supply by the water supply unit 40 after a lapse of a predetermined time from completion of discharge of the electrolytic solution S within the housing 14. Specifically, when stopping the water supply, the control device 60 transmits a control signal to the pressure pump 43 so as to stop the pressure pump 43. In addition, the control device 60 transmits a control signal to the suction pump 53 so as to stop the suction pump 53 to stop discharge of the wash water A. It should be noted that as appropriate, the control device 60 may transmit a control signal to the on-off valve 31 so as to close the on-off valve 31 that is in the open position. Accordingly, it is possible to wash the metal film F while holding the state where the wash water A may easily flow between the solid electrolyte membrane 12 and the metal film F.

It should be noted that herein, the present embodiment has described the example of discharging the electrolytic solution S by controlling the on-off valve 31, but a suction pump (not shown) provided downstream of the on-off valve 31 so as to be able to discharge the electrolytic solution S to the storage tank 32 may be provided to discharge the electrolytic solution S.

2-5. Regarding Substrate Removing Step S5

Next, the film forming method performs a substrate removing step S5. In this step, the substrate W with the metal film F having been washed is removed from the film forming apparatus 1. Specifically, the housing 14 is moved up to a predetermined position (see FIG. 1), and the solid electrolyte membrane 12 is separated from the substrate W with the surface of the metal film F having been washed.

In the present embodiment, even if the electrolytic solution S remains on the surface of the metal film F during film formation, the film forming method performs washing of the surface of the metal film F as described above, and thus there is almost no electrolytic solution S remaining on the metal film F. Therefore, even when the solid electrolyte membrane 12 is separated from the substrate W and the metal film F is exposed to the air, it is possible to reduce the occurrence of discoloring and alteration of the metal film F caused by drying of the electrolytic solution S.

EXAMPLES

Hereinafter, examples of the present disclosure will be described.

Example 1

As a substrate on which a film is to be formed on its surface, a glass epoxy substrate having a Cu film formed on its surface (10 cm×10 cm×500 nm as a thickness of a Cu film) was prepared. Next, by using the film forming apparatus shown in FIG. 1, a copper film was formed according to the film forming method shown in FIG. 4. A copper sulfate plating solution containing a brightener was used for an electrolytic solution. A Cu plate was used for an anode. Nafion N212 (available from DuPont) having a thickness of 8 μm was used for a solid electrolyte membrane.

A copper film having a thickness of 10 μm was formed under the test conditions including: a temperature of 42° C., a current density of 18 A/dm$^2$, a fluid pressure of 0.6 MPa, and a film formation time of 388 seconds. Next, after the pressing with the fluid pressure was released, the electrolytic solution within the housing was discharged and also supply of pure water by the water supply unit was started. After the electrolytic solution within the housing was completely discharged, the water supply by the water supply unit was stopped. Thereafter, the housing was moved upward and the substrate was removed and dried, whereby a test piece including a copper film formed on the surface of the substrate was prepared.

Comparative Example 1

In the same manner as Example 1, a test piece of Comparative Example 1 was prepared. In Comparative Example 1, however, water supply by the water supply unit was not performed. Comparative Example 1 differs from Example 1 in this respect. Specifically, after the pressing with the fluid pressure was released, the electrolytic solution within the housing was discharged without performing water supply by the water supply unit. After the discharge, the housing was moved upward and the substrate was removed, and thereafter the surface of the metal film was washed with pure water and dried, whereby a test piece was prepared.

Results and Considerations

The appearance of the test piece of Example 1 and the test piece of Comparative Example 1 was observed. In the test piece of Example 1, color shading was not found, and a metal film uniformly colored as a whole was formed. In contrast, in the test piece of Comparative Example 1, color shading, i.e., a portion turning red, was found. It was considered that this was because in Example 1, after film formation, the electrolytic solution remaining on the surface of the metal film was washed out from the metal film without being dried in a state where the solid electrolyte membrane was in contact with the metal film.

Although one embodiment of the present disclosure has been described in detail above, the present disclosure is not limited to the above embodiment, and various design changes can be made within the spirit and scope of the present disclosure recited in the claims.

What is claimed is:

1. A film forming apparatus for forming a metal film, comprising:

an anode;

a solid electrolyte membrane disposed between the anode and a substrate that serves as a cathode;

a power supply configured to apply a voltage across the anode and the substrate;

a housing including a storing chamber that stores an electrolytic solution together with the anode and having the solid electrolyte membrane attached thereto so as to seal the storing chamber; and a mount base on which the substrate is placed, the mount base being disposed to face the housing, wherein the voltage is applied in a state where the solid electrolyte membrane is pressed against a surface of the substrate with a fluid pressure of the electrolytic solution in the storing chamber to form a metal film from metal ions contained in the electrolytic solution on a surface of the substrate, a space where the metal film exists is sealed between the housing and the mount base in a state where the solid electrolyte membrane is in contact with the metal film, and the film forming apparatus further comprises:

a water supply unit comprising a pressure pump in communication with a water supply groove, configured to supply a wash water to the space being sealed such that the wash water flows onto a surface of the metal film that is in contact with the solid electrolyte membrane; and a water discharge unit comprising a suction pump in communication with a water discharge groove configured to discharge a wash water from the space being sealed such that the wash water having flowed onto the surface of the metal film flows out from the surface of the metal film, the housing is disposed above the mount base, the mount base includes a housing recess that houses the substrate, wherein the water supply groove is on a surface of the mount base, wherein the water discharge groove is on a surface of the mount base, the water supply groove and the water discharge groove are formed in opposite positions with the housing recess interposed therebetween, a frame-like sealing member for sealing the space is disposed on an edge of the mount base so as to surround the water supply groove, the water discharge groove, and the housing recess, the film forming apparatus further comprises:

a liquid discharge mechanism comprising a communication passage through the housing configured to discharge an electrolytic solution from the storing chamber; and a control device configured to control at least discharge of the electrolytic solution by the liquid discharge mechanism and supply of the wash water by the water supply unit, and the control device causes the liquid discharge mechanism to discharge the electrolytic solution in the storing chamber such that a pressing force of the solid electrolyte membrane pressing the substrate decreases, and causes the water supply unit to supply the wash water such that the solid electrolyte membrane deforms so as to be separated from the surface of the substrate and such that the wash water is poured between the solid electrolyte membrane and the metal film.

2. The film forming apparatus of claim 1, wherein a second sealing member is pressed against an edge of the solid electrolyte membrane to seal the storing chamber.

3. The film forming apparatus of claim 2, wherein the second sealing member is inserted into an insertion groove, and an edge of the solid electrolyte membrane is bent and the second sealing member pressed against the edge of the solid electrolyte membrane.

4. The film forming apparatus of claim 3, wherein the insertion groove is formed around the opening of the storing chamber, and the frame-like sealing member is formed around the insertion groove.

5. The film forming apparatus of claim 1, wherein the water supply unit further comprises a water supply passage through the housing in fluid communication between the pressure pump and the water supply groove.

6. The film forming apparatus of claim 1, wherein the water discharge unit further comprises a water discharge passage through the housing in fluid communication between the suction pump and the water discharge groove.

* * * * *